US010213366B2

(12) United States Patent
Todd et al.

(10) Patent No.: US 10,213,366 B2
(45) Date of Patent: Feb. 26, 2019

(54) PACIFIER ASSEMBLY COMPRISING OUTER CONTAINER, WRISTBAND, AND TETHER

(71) Applicant: TWL, LLC, Richland, NC (US)

(72) Inventors: Donald Loveless Todd, Richlands, NC (US); Paul Bradley Forrest, Cary, NC (US)

(73) Assignee: TWL, LLC, Richland, NC (US)

( * ) Notice: Subject to any disclaimer, the term of this patent is extended or adjusted under 35 U.S.C. 154(b) by 137 days.

(21) Appl. No.: 15/417,202

(22) Filed: Jan. 26, 2017

(65) Prior Publication Data

US 2018/0028412 A1 Feb. 1, 2018

Related U.S. Application Data

(60) Provisional application No. 62/367,737, filed on Jul. 28, 2016.

(51) Int. Cl.
*A61J 17/00* (2006.01)
*A61J 1/00* (2006.01)

(52) U.S. Cl.
CPC ..... *A61J 17/001* (2015.05); *A61J 1/00* (2013.01); *A61J 17/008* (2015.05)

(58) Field of Classification Search
CPC ..... A61J 17/00; A61J 17/001; A61J 17/002; A61J 17/003; A61J 17/005; A61J 17/006; A61J 17/007; A61J 17/008; B66D 3/10; B66D 5/34; A45F 5/004
See application file for complete search history.

(56) References Cited

U.S. PATENT DOCUMENTS 1,831,666 A * 11/1931 Jacobia ..... A45F 5/004 242/385.4
2,834,350 A * 5/1958 Beck, Jr. ..... A61J 17/001 606/236
D225,039 S * 10/1972 Sauritis ..... D24/195
4,903,698 A * 2/1990 Huber ..... A61J 9/06 24/17 AP
4,977,860 A * 12/1990 Harwell ..... A01K 27/004 119/794
5,150,504 A * 9/1992 Cohen ..... A45F 5/02 24/3.13
5,156,617 A * 10/1992 Reid ..... A61J 17/008 606/234
5,211,656 A * 5/1993 Maddocks ..... A61J 17/001 606/234
5,553,810 A * 9/1996 Bobeczko ..... B23K 9/1333 206/402
5,948,003 A * 9/1999 Shefflin ..... A61J 17/008 606/234

(Continued)

*Primary Examiner* — Shaun David
*Assistant Examiner* — Brigid K Byrd
(74) *Attorney, Agent, or Firm* — Forrest Firm

(57) ABSTRACT

An assembly for a pacifier is provided. The assembly includes a container defining a cavity for housing a bulbous portion of a pacifier, a tether for coupling the container to the pacifier, a spool housed within the container for permitting translation of the pacifier in relation to the container, and a band extending through a slot defined by the container for selectively engaging the assembly to an object or person. Configurations are provided to manage rotation of the spool for ease of use.

14 Claims, 14 Drawing Sheets

(56) References Cited

U.S. PATENT DOCUMENTS 5,964,784 A * 10/1999 Wang ..... A61J 17/001 606/234
6,026,585 A * 2/2000 Li ..... G01B 3/1005 242/381.3
6,053,447 A * 4/2000 Omri ..... G01B 3/1041 242/375
6,092,791 A * 7/2000 Kingery ..... B66D 3/04 254/371
6,213,421 B1 * 4/2001 Franklin ..... B60C 27/066 152/219
6,241,750 B1 * 6/2001 Moultrie ..... A45F 5/004 606/234
6,243,921 B1 * 6/2001 Chang ..... A61J 17/00 24/3.13
6,405,683 B1 * 6/2002 Walter ..... A01K 27/004 119/772
6,434,797 B1 * 8/2002 Sagman ..... A61J 17/00 24/3.1
6,502,727 B1 * 1/2003 Decoteau ..... A45F 5/004 224/162
6,526,918 B1 * 3/2003 Arnold ..... A01K 27/004 119/796
6,904,872 B2 * 6/2005 Muller ..... A01K 27/004 119/789
7,195,413 B2 * 3/2007 Kremizis ..... A45F 5/004 224/162
7,617,858 B2 * 11/2009 Hoffmann ..... E06B 9/323 160/11
7,661,567 B2 * 2/2010 Myers ..... A45C 13/20 224/162
7,661,620 B2 * 2/2010 Fields ..... A45F 5/004 224/162
8,757,532 B2 * 6/2014 Votel ..... B65H 75/4434 242/378
9,179,762 B2 * 11/2015 Paugh ..... A45F 5/004
9,339,014 B1 * 5/2016 Wettermann ..... A01K 27/004
9,883,988 B1 * 2/2018 Kunnbasi ..... A61J 17/008
2003/0014078 A1 * 1/2003 Robbins ..... A61J 17/02 606/235
2004/0178085 A1 * 9/2004 Rohrig ..... A45C 11/24 206/205
2005/0252939 A1 * 11/2005 Schuck ..... A45F 5/004 224/162
2008/0313862 A1 * 12/2008 Brekke-Hutchings ..... A63H 33/006 24/3.13
2010/0206976 A1 * 8/2010 Salentine ..... A45F 5/004 242/379.2
2011/0024599 A1 * 2/2011 Finell ..... A61J 17/00 248/523
2013/0089276 A1 * 4/2013 Noble ..... A61J 17/008 383/42
2014/0005722 A1 * 1/2014 Whelan ..... A45F 5/02 606/234
2014/0257388 A1 * 9/2014 Dunn ..... A45F 5/02 606/236
2015/0157116 A1 * 6/2015 Williams ..... A45F 5/004 224/162
2015/0272832 A1 * 10/2015 Diamond ..... A61J 17/008 606/236
2016/0008231 A1 * 1/2016 Peck ..... A61J 17/00 24/3.1
2016/0050774 A1 * 2/2016 Merenda ..... H05K 5/0086 224/162
2016/0213136 A1 * 7/2016 Roehrig ..... A45F 5/00
2018/0028412 A1 * 2/2018 Todd ..... A61J 17/001

* cited by examiner

PACIFIER ASSEMBLY COMPRISING OUTER CONTAINER, WRISTBAND, AND TETHER

TECHNICAL FIELD

The presently disclosed subject matter is generally directed to a pacifier assembly comprising a pacifier, a container enclosing the pacifier, a tether, and a wristband.

BACKGROUND

Pacifiers of various designs are well known and have been in use for many years. For infants and toddlers, the pacifier is often used to relieve the pain and irritability experienced from incoming teeth. One common problem, however, is the need to constantly retrieve the pacifier and/or replace it each time the child drops it or spits it out. In addition, when the pacifier is dropped, it frequently touches a contaminated surface such that the pacifier must be cleaned before use by the infant. It would therefore be beneficial to provide a device that secures the pacifier and enables it to be stored in a sanitary environment.

SUMMARY

This summary is provided to introduce in a simplified form concepts that are further described in the following detailed descriptions. This summary is not intended to identify key features or essential features of the claimed subject matter, nor is it to be construed as limiting the scope of the claimed subject matter.

According to at least one embodiment, an assembly is provided. The assembly includes a container defining a cavity for housing a bulbous portion of a pacifier; a tether for coupling the container to the pacifier; a spool housed within the container for permitting translation of the pacifier in relation to the container; and a band extending through a slot defined by the container for selectively engaging the assembly to an object or person.

According to some embodiments, the assembly defines a stored position in which the pacifier is housed within the cavity of the container and an extended position in which the pacifier is a distance from the cavity of the container, and wherein the assembly is biased to the stored position.

According to some embodiments, the biasing is created using a spring engaged with the spool and an extension of the container.

According to some embodiments, the cavity defines a divot shaped for accepting the bulbous portion and an open side for permitting translation of the pacifier in relation to the container.

According to some embodiments, the assembly further includes a ring affixed to the tether and selectively engaged with the pacifier.

According to some embodiments, the ring and the container each include at least one magnet for selectively engaging the ring to the container.

According to some embodiments, the assembly further includes the pacifier.

According to some embodiments, the band is flexible and includes spring bands therein for conforming about an object or person when force is applied to a point on the band.

According to some embodiments, the assembly further includes a complimentary band including at least one magnet, wherein the band is rigid and includes at least one additional magnet for selectively engaging the complimentary band.

According to some embodiments, the assembly further includes at least one spool protrusion defined by the spool and at least one container protrusion defined by the container for impeding rotation of the spool.

According to some embodiments, the cavity is positioned on an upper half of the container opposite a lower half of the container, and the assembly further includes at least one spool projection defined by a base of the spool; and at least one container projection defined by the container for impeding rotation of the spool when the pacifier is positioned closer to the upper half than the lower half of the container.

BRIEF DESCRIPTION OF THE DRAWINGS

The previous summary and the following detailed descriptions are to be read in view of the drawings, which illustrate particular exemplary embodiments and features as briefly described below. The summary and detailed descriptions, however, are not limited to only those embodiments and features explicitly illustrated.

DETAILED DESCRIPTION

Figure 1:
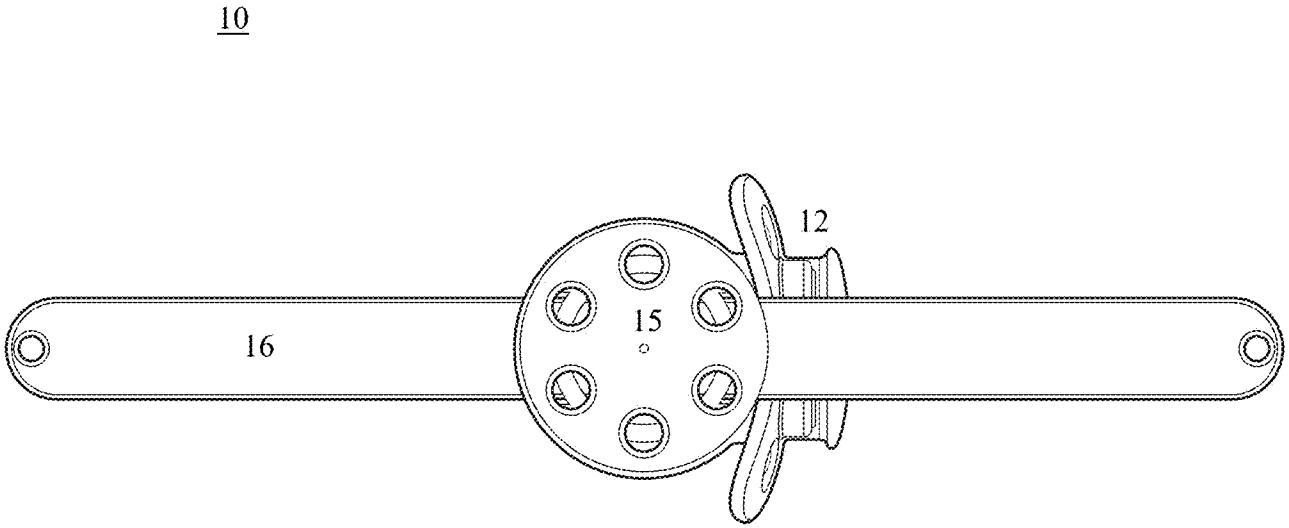
FIG. 1 is a bottom-facing view of the pacifier assembly in accordance with embodiments of the presently disclosed subject matter.

These descriptions are presented with sufficient details to provide an understanding of one or more particular embodiments of broader inventive subject matters. These descriptions expound upon and exemplify particular features of those particular embodiments without limiting the inventive subject matters to the explicitly described embodiments and features. Considerations in view of these descriptions will likely give rise to additional and similar embodiments and features without departing from the scope of the inventive subject matters. Although the term "step" may be expressly used or implied relating to features of processes or methods, no implication is made of any particular order or sequence among such expressed or implied steps unless an order or sequence is explicitly stated.

Any dimensions expressed or implied in the drawings and these descriptions are provided for exemplary purposes. Thus, not all embodiments within the scope of the drawings and these descriptions are made according to such exemplary dimensions. The drawings are not made necessarily to scale. Thus, not all embodiments within the scope of the drawings and these descriptions are made according to the apparent scale of the drawings with regard to relative dimensions in the drawings. However, for each drawing, at least one embodiment is made according to the apparent relative scale of the drawing.

Following long standing patent law convention, the terms "a", "an", and "the" refer to "one or more" when used in the subject application, including the claims.

The terms "comprises" and "comprising" are intended to have the broad meaning ascribed to them in U.S. Patent Law and can mean "includes", "including", and the like.

The term "container" as used herein refers to any type of vessel adapted to accommodate a pacifier in accordance with the presently disclosed subject matter.

The term "tether" as used herein refers to a member that extends between and attaches two separate components, such as a pacifier and a container.

A pacifier assembly 10 according to some embodiments of the presently disclosed subject matter is described herein. Specifically, assembly 10 may include a pacifier 12, a container 14 for housing the pacifier when not in use, and/or a band 16 for carrying the container 14. Assembly 10 can be used for storing, transporting, and protecting pacifier 12 from contaminants when the pacifier 12 is not being used by a child or infant. In addition, the assembly 10 can prevent the pacifier 12 from being exposed to contaminants during use, such as when the pacifier 12 falls from a child or infant's (user's) mouth.

Figure 4:
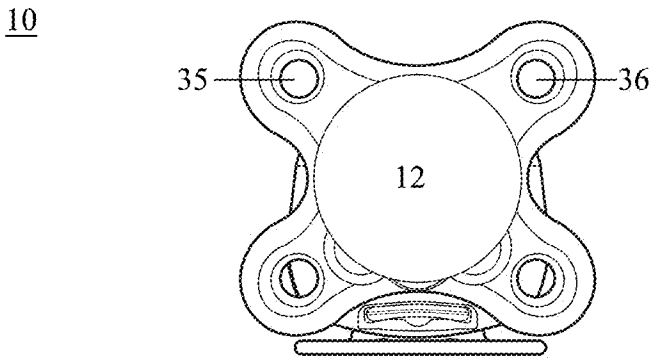
FIG. 4 is a pacifier side-facing view of the pacifier assembly in accordance with embodiments of the presently disclosed subject matter.
Figure 5:
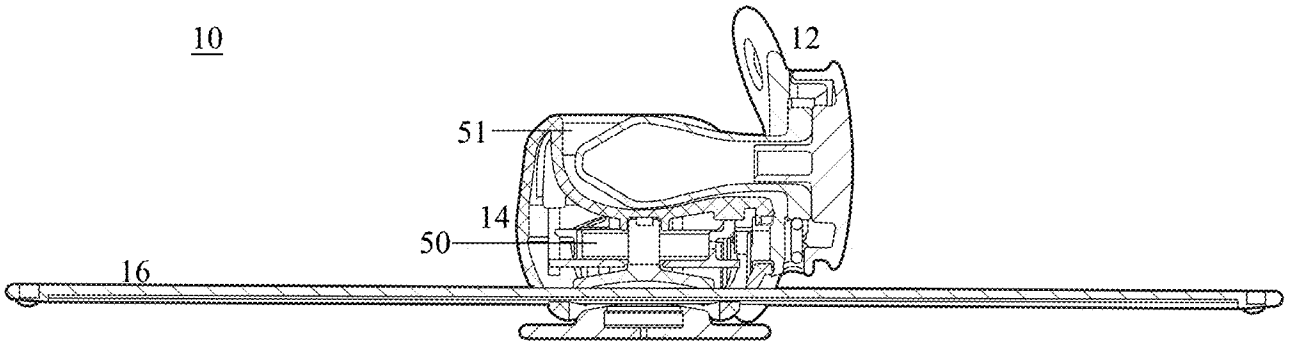
FIG. 5 is a front-facing cross-sectional view of the pacifier assembly in accordance with embodiments of the presently disclosed subject matter.
Figure 6:
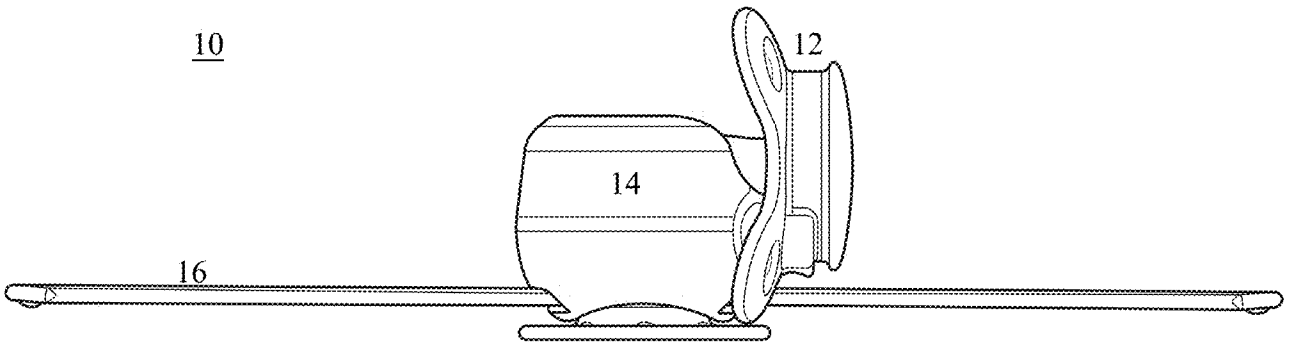
FIG. 6 is a front-facing view of the pacifier assembly in accordance with embodiments of the presently disclosed subject matter.
Figure 7:
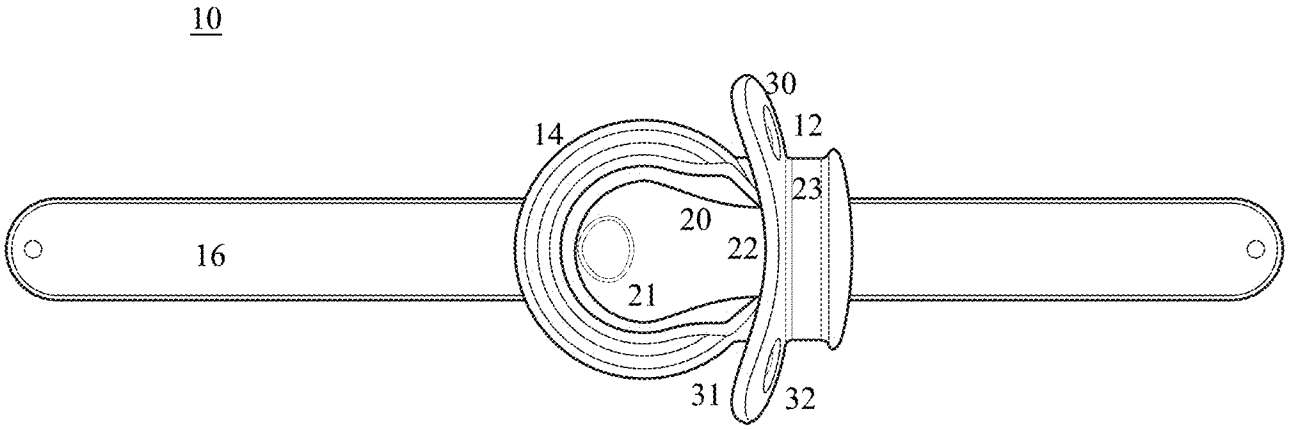
FIG. 7 is a top-facing view of the pacifier assembly in accordance with embodiments of the presently disclosed subject matter.
Figure 8:
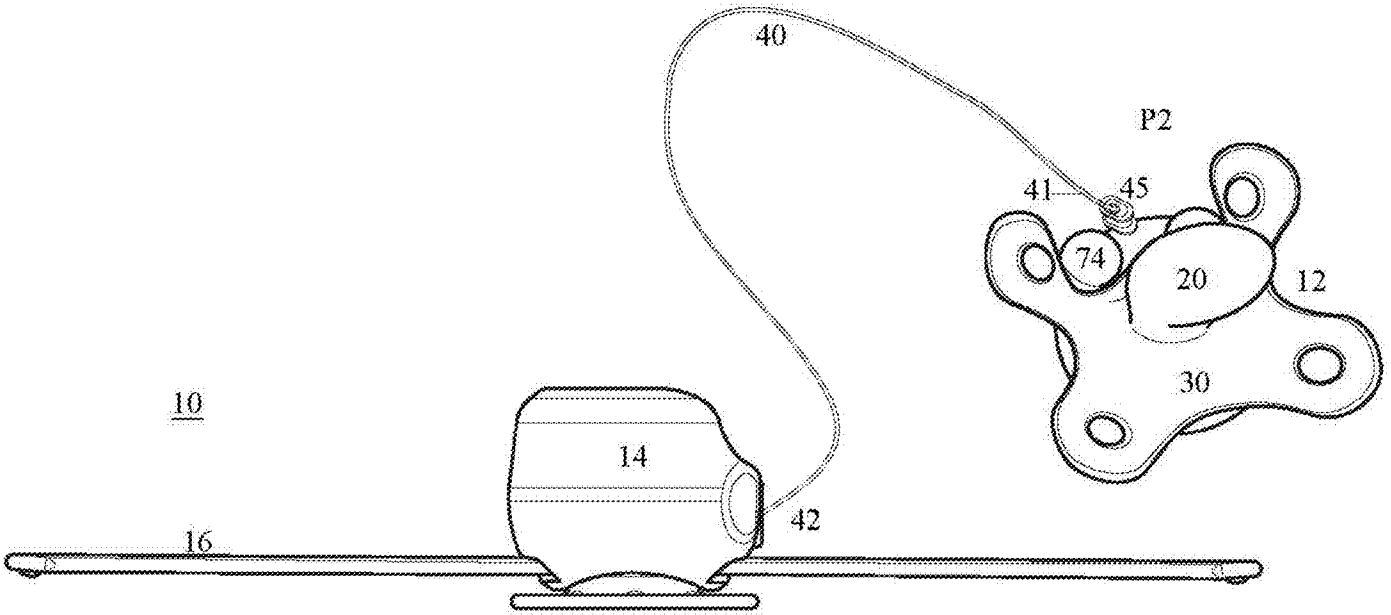
FIG. 8 is a front-facing view of the pacifier assembly without a pacifier in accordance with embodiments of the presently disclosed subject matter.

Thus, assembly 10 comprises pacifier 12 which can include any pacifier 12 known and used in the art (see, e.g., FIG. 7). In some embodiments, pacifier 12 comprises a conventional structure that includes nipple portion 20 for insertion into the mouth of a user. Nipple portion 20 comprises proximal end 22 engaged to a guard 30 that extends laterally outward from the nipple portion 20 to ensure that the nipple portion 20 cannot be swallowed or ingested beyond proximal end 22. Guard 30 includes first side 31 facing the nipple portion 20 for resting against the mouth and/or face of the user to prohibit the user from swallowing or choking on the pacifier 12. In addition, guard 30 may comprise a second side 32 opposite first side. In some embodiments, the guard 30 may include one or more grasping elements 35. For example, grasping element(s) 35 may include one or more grasping apertures 36 extending through the guard 30 (see, e.g., FIG. 4). Alternatively, or additionally, grasping element(s) 35 may include one or more rings, slots, openings, and the like extending from the second side 32 for accommodating a tether 40, as set forth in detail below. Pacifier 12 can be constructed from any material known and used in the art, including (but not limited to) rubber, plastic, silicone, elastic, or combinations thereof.

Figure 12:
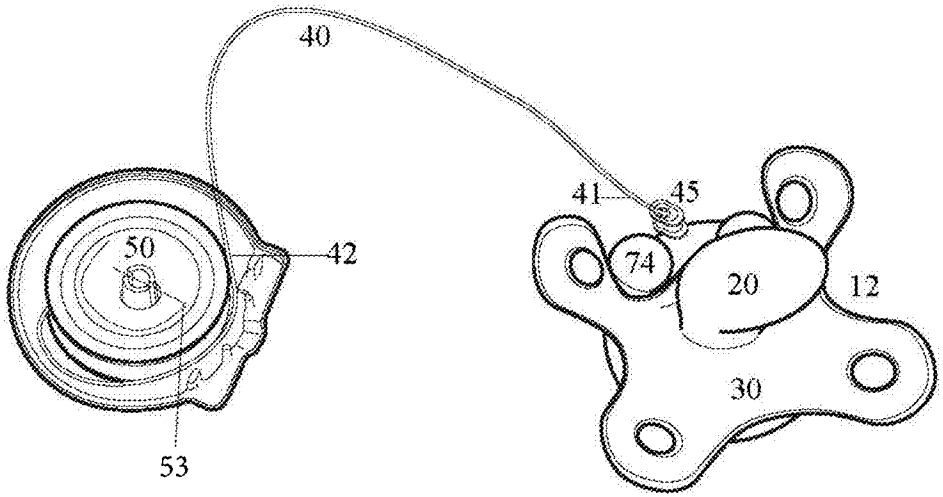
FIG. 12 is a perspective view of a lower half of the container engaged with a spool tethered to a pacifier in accordance with embodiments of the presently disclosed subject matter.
Figure 13E:
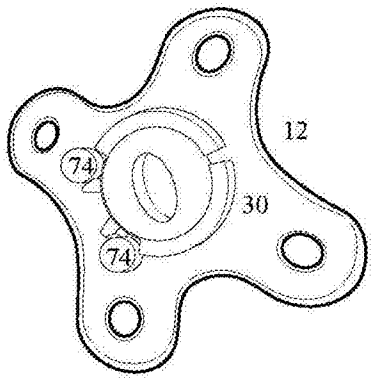
FIGS. 13A through 13E are perspective views of the lower half of the container, the upper half of the container, the spool, the complimentary spool and the pacifier in accordance with embodiments of the presently disclosed subject matter.
Figure 13D:
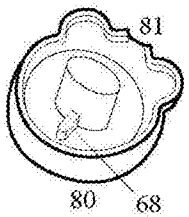
Figure 13C:
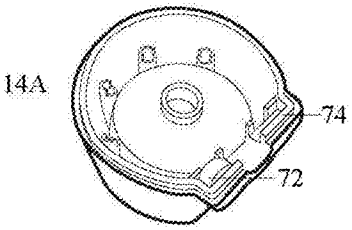
Figure 13B:
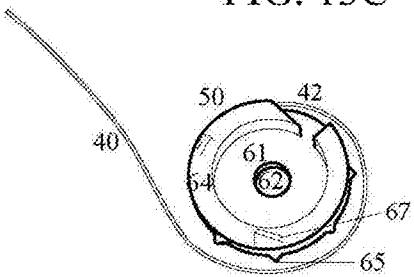
Figure 13A:
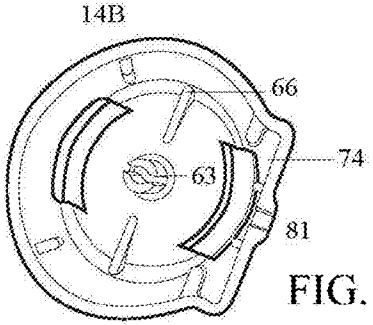

In some embodiments, a first end 41 of tether 40 may be attached to the pacifier 12 at any point, including any grasping element 35 using any of the wide variety of known connecting elements 45 (see, e.g., FIG. 12). For example, in some embodiments, the connecting element 45 can include adhesives, spot welding, snaps, hooks, hook and loop fasteners, and other mechanical closures known and used in the art to attach a first end of tether 40 to grasping element 35 of the pacifier 12. Thus, tether 40 engages the pacifier 12 for preventing it from dropping to the floor when it falls from the user's mouth or control. The tether 40 also keeps the pacifier 12 within reach of the user so that it can be easily retrieved. In some embodiments, the first end 41 of the tether 40 may be coupled to the pacifier 12. The first end 41 may be coupled to a portion of the guard 30, either externally or internally.

Tether 40 may be of sufficient length for permitting extension of the pacifier 12 from the container 14 and/or band 16 to the user's mouth, and may additionally permit greater degrees of freedom for ease of use. Tether 40 can be constructed from any of a wide variety of materials known and used in the art. For example, in some embodiments, the tether 40 can be constructed from a non-toxic, flexible, and/or washable material. In some embodiments, the tether 40 can be formed from stretchable elastic material, such as spandex, elastane, or blends thereof. An anti-bacterial coating may be applied to the tether 40, as well as any other component of the assembly 10.

For purposes of aesthetic appeal and/or marketing, tether 40 may be constructed in a variety of colors and can include designs and/or decorative images printed onto the tether 40 or integrated (e.g., woven) into the material forming the tether 40. For example, the colors or designs can be specifically directed towards boys or girls (e.g., using blue or pink colors) or can be selected for use in celebrating a particular occasion, such as Halloween or Christmas. It should be appreciated that the possible designs and colors are not limited. In some embodiments, tether 40 can have a length of about two feet to about four feet when fully extended.

The second end 42 of the tether 40, opposite the first end 41 of the tether 40, may be attached to a spool 50 using any method known in the art, including (but not limited to) adhesives, mechanical closures, and the like. The spool 50 may be housed within the container 14. In some embodiments, the spool 50 may include a base 61 with a base aperture 62 therethrough. The second end 42 of the tether 40 may be attached to spool 50 using an attachment device, such as (but not limited to) clips, clamps, and other mechanical attachments. The spool 50 may define an outer circumference 64 for housing the tether therein. For example, the outer circumference 64 may include a concave groove along its entire length for accepting the tether 40 therein.

The container 14 may include an extension 63 for extending through the aperture 62 onto which the spool 50 may be mounted and rotatable. A spring 53 may be mounted within the spool 50 for permitting retraction of the tether 40 when the first end 41 of the tether 40 is extended away from the spool 50. The spring 53 may be engaged or affixed to the extension 63. Spool 50 may exert sufficient force to retract tether 40 back into spool 50 when the pacifier 12 is not in use. Particularly, in some embodiments, the spring 53 mounting of the spool 50 within the container 14 may bias the tether 40 to coil about the spool 50 when the tether 40 is extended away from the spool 50. Coiling may be effected by rotating the spool 50 about the extension 63.

The pacifier 12, tether 40 and/or spool 50 may each have a resting position P1 and an extended position P2 (e.g., compare FIG. 3 to FIG. 8). When in the resting position P1, the first end 41 of the tether 40 and the pacifier 12 may be positioned proximal to the container 14. When in the extended position P2, the first end 41 of the tether 40 and the pacifier may be extended a distance from the container 14. During use, a user may find the assembly 10 in the resting position P1 and choose to extend the pacifier 12 a distance away from the container 14. During such extension, the tether 40 may be gradually uncoiled from about the spool 50 as the first end 41 of the tether 40 is extended away from the spool 50 and container 14, and the spool 50 rotates about the extension 63.

In other words, although the tether 40 may be biased to coil about the spool 50, the tether 40 may remain capable of extending away from the spool 50 in response to applied tensile forces. Once the tensile force is removed (e.g., releasing from the user's mouth or hand), the tether 40 and spool 50 may shift from the extended position P2 to the resting position P1. The spring 53 may be set to bias the spool 50 to be fully wound in the resting position P1 such that when the tether 40 is pulled away from the spool 50 turns and energy is stored in the spring 53. The energy from the spring 53 biases the spool 50 to wind. Accordingly, when there is any slack present in the extended tether 40, the slack is rewound onto the spool 50. Thus, the biasing feature of tether 40 allows it to "give" in response to a user's movements when the pacifier 12 is in use.

In some embodiments, the circumference 64 of the spool 50 may include one or more spool protrusions 65 and the interior of the container may include one or more container protrusions 66 (see, e.g., FIG. 13). When the spool 50 rotates, the spool protrusion(s) 65 may engage the container protrusion(s) 66 in an intermittent manner, creating friction and resistance against the rotation of the spool 50. Such features may be useful in controlling or impeding the retraction speed of the pacifier 12 towards the container 14 as the tether 40 is retracted within the container 14 and positioned about the circumference 64 of the spool 50. In some instances, without the protrusions 65, 66, the pacifier 12 may retract towards the container 14 with an undesired speed or force.

The spool protrusion(s) 65 may be ramped in one direction, allowing the protrusion(s) 65 to interact with the container protrusion(s) 66 in such a way as to ramp past each container projection 66 while minimizing interference or impedance of the free rotation of the spool 50 or preventing tether 40 extension. However, when these ramped spool protrusion(s) 65 interact with the container protrusion(s) 66 in the opposite rotation of the spool 50, each spool protrusion 65 will rest against the container protrusion(s) 66, impeding rotation of the spool 50 in a tether 40 retraction direction.

In yet another embodiment, one or more spool projections 67 may be positioned on the spool 50. For example, the spool projection(s) 67 may be placed on the base 61 of the spool 50, on the top of the circumference 64 opposite the base 61 (see, e.g., FIG. 13), and/or another place on the spool 50. The interior of the container 14 may also define or include one or more container projections 68 for interacting with the spool projection(s) 67. In some embodiments, the container projection(s) 68 may be defined by a complimentary spool 80 (see, e.g., FIG. 13). These projections 67, 68 may be positioned such that when the tether 40 extends perpendicularly from the container 14, the rotation of the spool 50 does not permit interaction between the projections 67, 68. A perpendicular extension of the tether 40 in relation to the container 14 ensures that the plane of the base 61 is also perpendicular.

Further, when the tether 40 extends at an angle above perpendicular, towards the cavity-side of the container 14, the plane of the base 61 of the spool 50 may be biased within the container 14 towards the cavity 51 during rotation and the projections 67, 68 interact. Even further, when the tether 40 extends at an angle below perpendicular, away from the cavity-side of the container 14, the plane of the base 61 of the spool 50 may be biased away from the cavity 51, towards the container projection 68, thereby not permitting the projections 67, 68 to interact with each other during rotation. Such interaction may impede the rotation of the spool 50, thereby preventing the retraction of the pacifier 14 during slight and brief tension changes on the tether 40, such as when a user is chewing or adjusting the pacifier 14 within the mouth. This may help to prevent the pacifier 14 from retracting when still in use but not tightly secured. Alternatively, when the tether 40 extends at an angle below perpendicular, such as when the pacifier 14 is dropped from the mouth, it changes the spool 50 angle such as to prevent the engagement of projections 67,68, thereby allowing the unimpeded retraction of the tether 40 and pacifier 14.

Figure 10B:
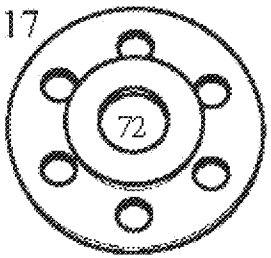
FIGS. 10A and 10B are perspective views of the pacifier assembly in accordance with embodiments of the presently disclosed subject matter.
Figure 10A:
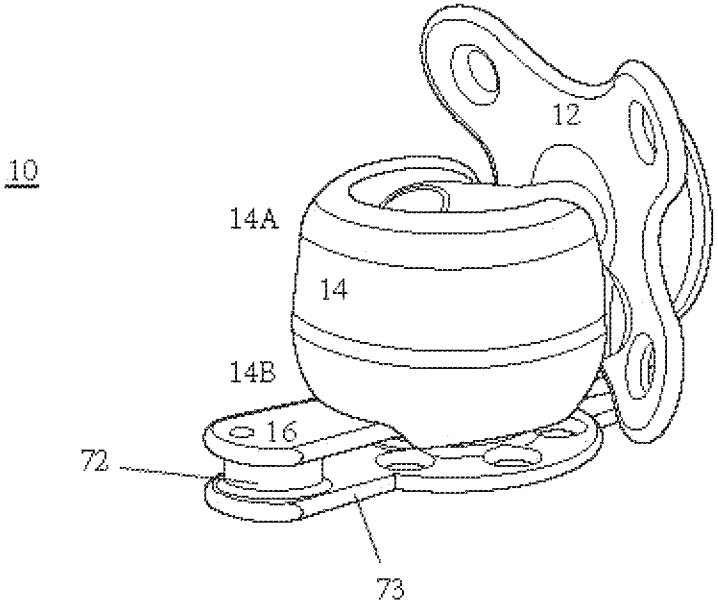

Stated another way, referring to FIGS. 10 and 13, as the tether 40 is translated through the exit 81 of the container 14, the tether 40 is either positioned perpendicular to the container 14, biased towards the upper half 14A of the container 14, or biased towards the lower half 14B of the container 14. When the tether 40 is biased towards the upper half 14A of the container 14, the spool 50 is biased within the container 14, allowing the spool projections 67 to interact with the container projection 68 during rotation of the spool 50. When the tether is biased towards the lower half 14B of the container 14, the spool 50 is biased within the container 14 is the opposite direction, pulling the spool projections 67 away from the container projection 68, disallowing interaction between the projections 67, 68.

The spool projection(s) 67 may be ramped in one direction, allowing the projection(s) 67 to interact with the container projection(s) 68 in such a way as to ramp past each container projection(s) 68 while minimizing interference or impedance of the free rotation of the spool 50 or preventing tether 40 extension. However, when these ramped spool projection (s) 67 interact with the container projections 68 in the opposite rotation of the spool 50, each spool projection 67, when allowed to interact because of the resultant spool 50 angle, will rest against the container projection 68, impeding rotation of the spool 50 in a tether 40 retraction direction.

The pacifier assembly 10 may further include a container 14 for housing the pacifier 12 when the pacifier is in the resting position P1. The container 14 may be engaged with, or permanently affixed to, a band 16 (see, e.g., FIGS. 5 and 6). In one embodiment, the container 14 may include a slot 24 extending therethrough for accepting a band 16 (see, e.g., FIG. 2). The container 14 may then be selectively engaged with the band 16 by sliding the band 16 through the slot 24. The band 16 may define mounds or other frictional elements for engaging the container 14 and/or slot 24 for creating friction between the container 14 and the band 16. These frictional elements may assisting in locking the container 14 into position relative to the band 16 such that undesired container 14 disengagement from the band 16 may be minimized. The container 14 may include a flat portion 15 for resting upon the body of the user or object to which the assembly 10 is coupled (see, e.g., FIG. 1). In some embodiments, the flat portion 15 may not be included.

Figure 2:
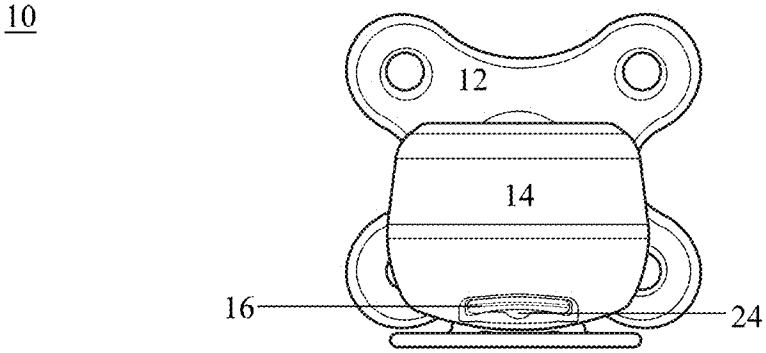
FIG. 2 is a container side-facing view of the pacifier assembly in accordance with embodiments of the presently disclosed subject matter.
Figure 3:
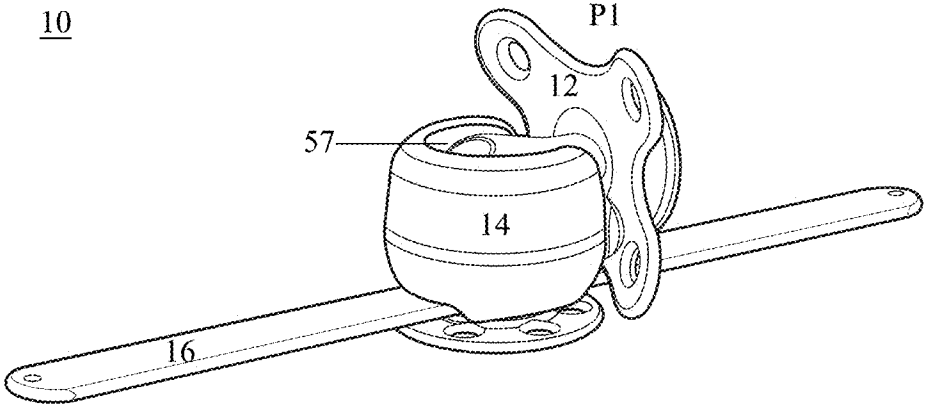
FIG. 3 is a perspective view of the pacifier assembly in accordance with embodiments of the presently disclosed subject matter.

In other embodiments, the slot 24 may be open on two or three sides for removably connecting the assembly 10 to a container, object or body part. For example, the slot 24 may permit connection to a shirt, button, high chair, carriage, stroller or seat. Alternatively, the slot may be configured to receive a band 16 for magnetically attaching the assembly 10 to a article of clothing, fabric or other thin material. For example, the band 16 may include one or more magnet(s) 72 therein or thereon. The assembly 10 may further include a complementary band 17 also including magnet(s) 72 therein or thereon for positioning on the other side of the thin material for securing the container 14 thereto when magnets 72 of the band 16 and the complimentary band 17 are positioned proximal to each other for attraction. Embodiments of the band 16 and complimentary band 17 are shown in FIG. 10. The band 16 may be configured as is shown in FIG. 10, defining a protuberance 73, or the band 16 may be configured as is shown in FIG. 1, without the protuberance 73. Similarly, the complimentary band 17 may or may not define a protuberance 73.

Figure 9:
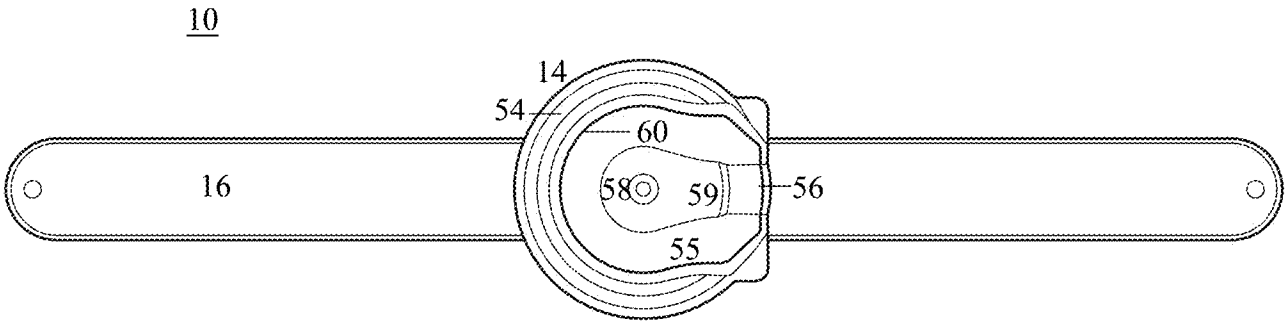
FIG. 9 is a top-facing view of the pacifier assembly without a pacifier in accordance with embodiments of the presently disclosed subject matter.

The container 14 may further define a cavity 51 for housing the nipple portion 20 of the pacifier 12 when the pacifier 12 is in the resting position P1 (see, e.g., FIG. 9). The cavity 51 may define a curved wall 54, a floor 55, a pacifier opening 56 and a top opening 57. The nipple portion 20 of the pacifier 12 may rest upon, or slightly above, the floor 55 of the cavity 51 when the pacifier 12 is in the resting position P1. The floor 55 may be shaped to conform to the shape of the nipple portion 20. For example, the floor 55 may define a centrally located dip 58 for conforming to a bulbous section 21 of the nipple portion 20 and a channel 59 for conforming to the nipple portion 20 positioned between the bulbous section 21 and the proximal end 22 of the nipple portion 20. The curved wall 54 may extend from an outer periphery 60 of the floor 55. The curved wall 54 may be arced in two substantially perpendicular directions, with a first direction extending away from the outer periphery 60 of the floor 55 and a second direction extending substantially parallel to the outer periphery 60 of the floor 55.

In some embodiments, the wall 54 of the container 14 may fully enclose the nipple portion 20 of the pacifier 12. In other embodiments, the wall 54 may define a top opening 57 without fully enclosing the nipple portion 20 of the pacifier 12. The top opening 57 may be sized to easily permit insertion and removal of the nipple portion 20 of the pacifier into the cavity 51 of the container 14 therethrough. A lid may be selectively engaged with the top opening 57 for enclosing the cavity 51. Further, the container 14 may define a pacifier opening 56 extending from the floor 55, the wall 54 and/or the top opening 57. The pacifier opening 56 may be sized to easily permit insertion and removal of the nipple portion 20 of the pacifier into the cavity 51 of the container 14 therethrough. Alternatively, the pacifier opening 56 may be shaped to disallow removal of the bulbous section 21 of the nipple portion 20 therethrough. Such an embodiment would disallow removal of the pacifier 12 from the cavity 51 when used in conjunction with the lid.

Figure 11B:
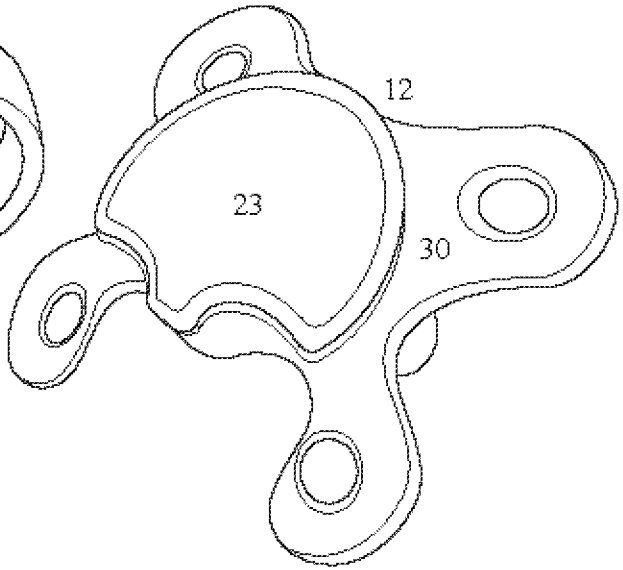
FIGS. 11A and 11B are perspective views of a pacifier and a ring in accordance with embodiments of the presently disclosed subject matter.
Figure 11A:
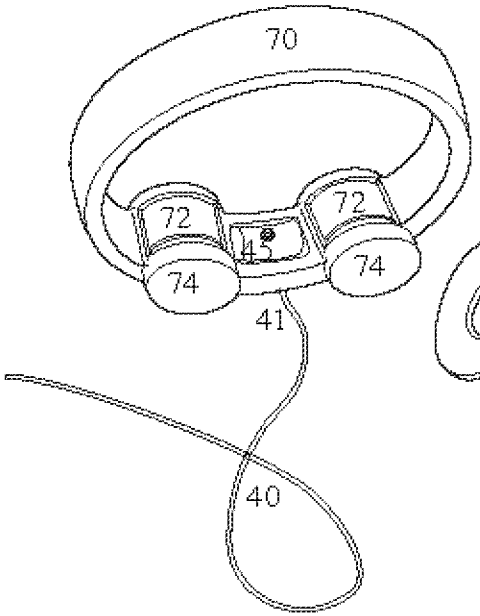
Figure 14:
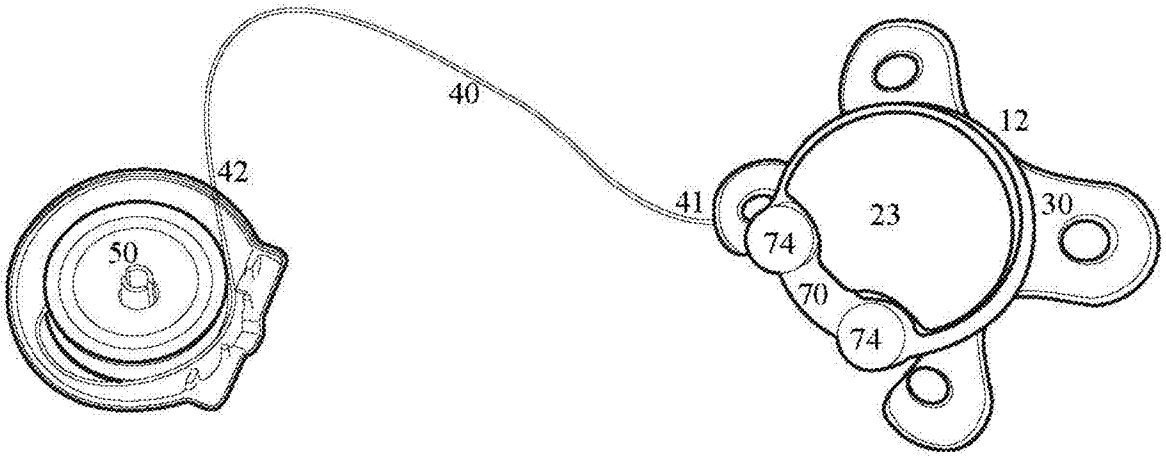
FIG. 14 is a perspective view of the spool tethered to a ring engaged with a pacifier in accordance with embodiments of the presently disclosed subject matter.

In some embodiments of the assembly 10, the first end 41 of the tether 40 may be affixed to a ring or attachment 70. The ring or attachment 70 may be selectively engageable with the pacifier 12 (see. e.g., FIG. 14). The ring or attachment 70 may be selectively engageable with any portion of the pacifier 12 for permitting the assembly 10 to be used with common and/or proprietary pacifiers 12 and/or for allowing the pacifiers 12 to be interchanged throughout use. For example, the ring or attachment 70 may be shaped to encircle the knob portion 23 of the pacifier 12. In another example, the ring or attachment 70 may be adjustable in size or circumference for adapting use with different sized pacifiers. In some embodiments, both the container 14 and the ring or attachment 70 may contain one or more magnets 72 for aligning the pacifier 12 with respect to the container 14 when the pacifier 12 is in close proximity to the container 14. The magnets 72 may be positioned within one or more pockets 74 defined by the container 14 and/or one or more pockets 74 defined by the ring or attachment 70 (see, e.g., FIG. 11). The pacifier itself 12 may define pockets 74 for housing one or more magnets 72 (see, e.g., FIG. 12).

The container 14 may be unitarily constructed or may be constructed in one or more parts. For example, the container 14 may be constructed using two halves selectively coupled together, thereby providing access to the interior of the container for replacing a magnet 72, a spring 53, or manipulating the spool 50 and/or tether 40. For example, turning to FIG. 13, the container 14 may include a upper half 14A and lower half 14B. The lower half 14B may define an extension 63 for engaging the spool 50 and/or spring 53. Further, the lower half 14B and/or upper half 14A may define pockets 74 for housing magnets 72. In some embodiments, the upper half 14A and lower half 14B may each define a portion of one or more pockets 74, which are wholly formed when the two halves 14A, 14B are coupled together.

Further, the container 14 may include a complimentary spool 80. The complimentary spool 80 may assist in stabilizing the spool 50 and providing rotational friction and/or biased friction to the spool 50 when rotating. For example, the complimentary spool 80 may include one or more frictional elements and/or container projections 68.

As has been discussed, the assembly 10 may further include a band 16. The band 16 may define two ends having fasteners for selectively engaging the ends to each other when the band 16 is extended about a wrist or other object (e.g., stroller, high chair, seat part, or other object or body part). The fasteners may include any fastening device known and used in the art, including (but not limited to) hook and loop fasteners, clips, snaps, magnets, and the like. The band 16 may be configured to extend through the slot 24 for engaging the container 14.

The band 16 may include an adjustment mechanism, such that one of the ends may be threaded through the adjustment mechanism as desired for selectively securing the band 16 to the wrist, other body part, or object. In some embodiments of the band 16, an adjustment wheel is provided for manipulating the adjustment mechanism.

It should be appreciated that any of the wide variety of wristbands known and used in the art are contemplated and considered for use as a band 16 herein. For example, in some embodiments, the wristband can be configured as a bracelet, rope, band, string, chain, etc. Band 16 can be constructed from fabric, plastic, rubber, or similar materials known and used in the art. In some embodiments, the wristband can include designs and/or writing, such as trademarks, logos, and/or child-friendly images. In some embodiments, the band 16 may be a 'snap bracelet' which conforms about a wrist, arm or object simply by applying pressure at a point between two ends of the band 16.

Notably, many products suitable for infants and children must include features that prevent the products from becoming choking hazards. As is depicted in some of the figures, one or more components of the pacifier assembly may include breathing holes therethrough to prevent the assembly, or its components, from becoming choking hazards.

It should be understood that various changes and modifications to the preferred embodiments described herein would be apparent to those skilled in the art. Such changes and modifications can be made without departing from the spirit and scope of the presently disclosed subject matter. It is therefore intended that such changes and modifications be covered by the appended claims. The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

Particular embodiments and features have been described with reference to the drawings. It is to be understood that these descriptions are not limited to any single embodiment or any particular set of features, and that similar embodiments and features may arise or modifications and additions may be made without departing from the scope of these descriptions and the spirit of the appended claims.

The invention claimed is:

1. An assembly comprising:

a container defining a cavity for housing a bulbous portion of a pacifier;

a tether for coupling the container to a ring, the ring selectively engageable with the pacifier;

a spool housed within the container for retracting the pacifier into a stored position from an extended position, wherein the bulbous portion is housed within the cavity in the stored position and is a distance from the cavity in the extended position; and the ring and the container each including at least one magnet for selectively engaging the ring to the container and positioning the pacifier within the cavity when the ring is engaged with the pacifier and the pacifier is retracted by the spool.

2. The assembly of claim 1, wherein the biasing is created using a spring engaged with the spool and an extension positioned within the container.

3. The assembly of claim 1, wherein the cavity defines a divot shaped for accepting the bulbous portion and an open side opposite the divot for permitting translation of the pacifier in relation to the container.

4. The assembly of claim 1, further including the pacifier.

5. The assembly of claim 1, wherein the band is flexible for conforming about an object or person when force is applied to a point on the band.

6. The assembly of claim 1, further comprising a complimentary band including at least one magnet, wherein the band is rigid and includes at least one additional magnet for selectively engaging the complimentary band.

7. The assembly of claim 1, further comprising at least one spool protrusion defined by the spool and at least one container protrusion defined by the container for impeding rotation of the spool by the at least one spool protrusion and/or at least one container protrusion.

8. The assembly of claim 7, wherein the at least one spool protrusion is positioned on a circumference of the spool.

9. The assembly of claim 7, wherein each of the at least one spool protrusion is ramped for impeding rotation of the spool during retraction of the pacifier more than impeding rotation of the spool during extension of the pacifier.

10. The assembly of claim 1:

wherein the cavity is positioned on an upper half of the container opposite a lower half of the container, further comprising:

at least one spool projection defined by a base of the spool; and at least one container projection defined by the container for impeding rotation of the spool when the pacifier is positioned closer to the upper half than the lower half of the container.

11. The assembly of claim 10, wherein each of the at least one spool projection is ramped for impeding rotation of the spool during retraction of the pacifier more than impeding rotation of the spool during extension of the pacifier.

12. The assembly of claim 1:

wherein the cavity is positioned on an upper half of the container opposite a lower half of the container, further comprising:

at least one spool projection defined by a top of a circumference of the spool; and at least one container projection for impeding rotation of the spool when the pacifier is positioned closer to the upper half than the lower half of the container.

13. The assembly of claim 12, wherein each of the at least one spool projection is ramped for impeding rotation of the spool during retraction of the pacifier more than impeding rotation of the spool during extension of the pacifier.

14. The assembly of claim 12, wherein the container further includes a complimentary spool defining the at least one container projection.

* * * * *